US008360704B2

(12) United States Patent
Sasamoto et al.

(10) Patent No.: US 8,360,704 B2
(45) Date of Patent: Jan. 29, 2013

(54) ADHESIVE APPLICATION APPARATUS AND BOOKBINDING APPARATUS

(75) Inventors: Shinya Sasamoto, Hokuto (JP); Atsushi Tsuchiya, Minamialps (JP)

(73) Assignee: Nisca Corporation, Minamikoma-Gun, Yamanashi-Ken (JP)

( * ) Notice: Subject to any disclaimer, the term of this patent is extended or adjusted under 35 U.S.C. 154(b) by 298 days.

(21) Appl. No.: 12/707,071

(22) Filed: Feb. 17, 2010

(65) Prior Publication Data

US 2010/0209215 A1 Aug. 19, 2010

(30) Foreign Application Priority Data

Feb. 18, 2009 (JP) ..... 2009-035904

(51) Int. Cl.
*B42C 9/00* (2006.01)
*B42C 13/00* (2006.01)
*G03G 15/00* (2006.01)

(52) U.S. Cl. ..... 412/37; 412/8; 412/11; 412/14; 399/408

(58) Field of Classification Search ..... 412/8, 11, 412/14, 37
See application file for complete search history.

(56) References Cited

U.S. PATENT DOCUMENTS 6,964,707 B2 * 11/2005 Taniguchi et al. ..... 412/37
7,448,837 B2 * 11/2008 Oota ..... 412/37
7,869,757 B2 * 1/2011 Hattori ..... 399/408
2005/0238462 A1 * 10/2005 Oota ..... 412/8
2007/0122256 A1 * 5/2007 Toyoizumi et al. ..... 412/37

FOREIGN PATENT DOCUMENTS

| | | |
|---|---|---|
| JP | 2004-209746 | 7/2004 |
| JP | 2005-047198 | 2/2005 |
| JP | 2005-047199 | 2/2005 |
| JP | 2007-076118 | 3/2007 |
| JP | 2008-001048 | 1/2008 |

* cited by examiner

*Primary Examiner* — Dana Ross
*Assistant Examiner* — Kyle Grabowski
(74) *Attorney, Agent, or Firm* — Manabu Kanesaka

(57) ABSTRACT

The present invention provides an adhesive application apparatus that forms a uniform application layer when applying an adhesive to a sheet bundle for a various a length or a width of the sheet bundle. The apparatus includes an applying operation controlling device including a reference value storing device for previously setting and storing a preset reference value of an application length and/or an application width of the sheet bundle, a size recognizing device for identifying an application length and/or an application width of the adhesive applied to the sheet bundle, and an application region comparing device for comparing an identified value of the application length and/or the application width of the adhesive applied to the sheet bundle from the size recognizing device with a preset reference value of the application length and/or the application width of the sheet bundle from the reference value storing device.

3 Claims, 12 Drawing Sheets

ADHESIVE APPLICATION APPARATUS AND BOOKBINDING APPARATUS

BACKGROUND OF THE INVENTION

1. Field of the Invention

The present invention relates to an adhesive application apparatus in a bookbinding apparatus and the bookbinding apparatus using this adhesive application apparatus and to an improvement in an adhesive application mechanism that applies a hot-melt adhesive to an end face of a back portion of a sheet bundle obtained by bundling as a copy.

2. Description of the Related Art

In general, this type of adhesive application apparatus is widely known as an apparatus that bundles sheets carried out from, e.g., an image forming apparatus as a copy, sets them at a predetermined adhesive applying position to be carried, provides a glue container that applies an adhesive on an end face of a back portion thereof, and performs immersion and application of an adhesive on an application roller arranged in this glue container. Further, a method for accommodating a hot melt (a hot-melt adhesive) in this glue container and controlling a temperature by using heating means is extensively adopted.

For example, Patent Document 1 (Japanese Patent Application Laid-open No. 2007-076118) suggests an apparatus that has a glue container arranged below a sheet bundle held in an upright posture and applies a predetermined amount of an adhesive by an application roller put in the glue container while moving this glue container along a back binding end face of the sheet bundle. This document discloses an apparatus in which a replenishing mechanism that supplies a solid adhesive to the glue container and heating means are provided and which uses the heating means to dissolve the solid adhesive supplied to the glue container.

When the thermally dissolvable (hot-melt) adhesive is accommodated in the glue container in this manner and it is thermally dissolved and applied to the sheet bundle, the adhesive must be replenished. In regard to this replenishment of the adhesive, when configuring the glue container with a large capacity and replenishing a large amount of adhesive at a time, there is a problem that dissolving the replenished adhesive requires a long time. This problem also occurs when, e.g., the adhesive in the glue container is solidified or semi-solidified (gelificated) to reduce an adhesive temperature during an interval that the apparatus is not utilized or the adhesive is applied.

Thus, for example, Patent Document 1 or Patent Document 2 (Japanese Patent No. 4147105) suggests an apparatus having a configuration that a glue container accommodating an adhesive is formed into a small shape with a relatively small capacity and the adhesive is supplied in accordance with a consumption state of the adhesive in the apparatus. This document discloses a replenishing mechanism having a configuration that a sensor which detects an adhesive amount is provided in the glue container and a predetermined amount of a solid adhesive is supplied in accordance with a detection signal from this sensor.

When applying the adhesive to a sheet bundle by an application roller provided in the glue container in this manner, a spin-coating mechanism that rotates a roller in the glue container and applying the adhesive with which a surface of the roller is impregnated while circulating the same cannot form and apply a uniform adhesive layer unless a fixed coating layer (the adhesive layer with which the roller is impregnated) is constantly formed on the roller surface facing an end face of the sheet bundle.

Further, for example, Patent Document 3 (Japanese Patent Application Laid-open No. 2008-001048) suggests control for increasing/decreasing a replenishing amount of an adhesive in accordance with a thickness of a sheet bundle in the above-described adhesive application mechanism as such the application roller. Likewise, Patent Document 4 (Japanese Patent Application Laid-open No. 2005-047198) and Patent Document 5 (Japanese Patent Application Laid-open No. 2005-047199) suggest increasing/decreasing a moving speed (an application speed) of a glue container and a rotating speed of the application roller (an adhesive supply amount) in accordance with a thickness of a sheet bundle.

The following problem is known in regard to the roller application mechanism that adjusts an application amount of an adhesive based on a moving speed (an applying speed) and a rotating speed (an adhesive replenishing amount) of the application roller when applying an adhesive to an end face of a sheet bundle as explained above. An application time is prolonged to affect a processing efficiency when this roller moving speed is reduced, and a sufficient amount of the adhesive cannot be supplied to the roller and an application layer cannot be uniformly held when a roller rotating speed is increased. Therefore, the moving speed and the rotating speed of the application roller are set to optimum values in accordance with properties of the adhesive, e.g., viscosity, and such set values are determined by identifying an apparatus specification and conducting experiments and others.

In this case, for example, when an optimum value is set to A4 size conforming to JIS and a bundle thickness is set to 20 mm, application unevenness of the adhesive occurs due to setting sheets to a large size (e.g., A3 size) of sheets or setting the bundle thickness to 50 mm. As to this application unevenness, the adhesive is not applied with a uniform application thickness in a longitudinal direction or a width direction (a thickness direction) of the sheets, and an insufficient portion where the adhesive layer is thin is produced. Such application unevenness results in page missing or irregularities on a spine at the time of bookbinding, thereby affecting a bookbinding quality.

The present inventor has discovered that such application unevenness of the adhesive occurs due to the following factor. This factor will now be described with reference to FIG. 12. An application roller 101 is pivotally rotatably supported in a glue container 100, and a roller lower half portion is dipped in an adhesive liquid whilst an upper half portion is exposed toward an adherend of a sheet bundle. In this state, the application roller 101 (or the glue container including the roller) is moved (an applying operation) in both front-side and back-side directions of the drawing at a moving speed Vt, and the application roller 101 is also rotated in an arrow direction in the drawing (a clockwise direction) at a speed Vr. The adhesive is applied to a sheet lower end face (a back binding surface) 102 based on this roller movement. At this time, a coating layer 105 is formed between a roller surface and the sheet lower end face 102. Further, a thickness of the coating layer 105 is an application thickness of the adhesive and, at the same time, the new adhesive in the glue container is supplied to the coating layer 105 based on rotation of the application roller 101 whilst the old adhesive is returned to the glue container.

In such an application mechanism providing an application roller, when the roller moving speed Vt is increased, the adhesive in the coating layer 105 becomes insufficient to cause the application unevenness. When this moving speed Vt of the application roller is reduced, an application time becomes long to decrease the efficiency. Furthermore, in regard to the rotating speed Vr of the application roller, a temperature of the adhesive to be applied is maintained constant by refluxing the adhesive in a liquid tank below the roller and the adhesive in the coating layer 105 above the roller. In particular, this roller speed must adequately enable circulation for scraping off the excessive adhesive once applied to the sheet end face to be returned to the liquid tank. It is, therefore, undesirable to increase the roller rotating speed Vr above an adequate value. It is to be noted that a heater element is usually included in the glue container 100 to detect a liquid temperature in the tank and control it to a predetermined temperature. This temperature is set a temperature that is higher than a melting point and maintains appropriate viscosity, and P2>P3>P1 is achieved where P1 is a temperature of the coating layer 105, P2 is a temperature of the heated portion, and P3 is a temperature of the liquid in the tank (see FIG. 1).

Thus, in regard to the application unevenness, the present inventor sets the roller rotating speed Vr that is utilized to properly maintain the temperature P1 of the coating layer 105. Therefore, a limit is produced in an adhesive amount supplied to the coating layer 105 formed on the roller upper surface. The present inventor has discovered that the application unevenness is produced from a relationship between a liquid amount in the coating layer stemmed on the roller upper surface and an application area.

It is an object of the present invention to provide an adhesive application apparatus that can form a uniform application layer even though a length or a thickness of a sheet bundle is equal to or above or below a predetermined size when applying the adhesive to an end face of the sheet bundle by an application roller.

Moreover, it is another object of the present invention to provide an adhesive application apparatus that can adjust an adhesive thickness applied by the application roller in a simple structure in accordance with an application region of a sheet bundle.

SUMMARY OF THE INVENTION

In order to achieve the objects, the present invention is characterized in that a liquid amount of a coating layer formed between the surface of the application roller and the application surface of the sheet bundle can be adjusted by increasing or decreasing based on an application length and/or an application width of the sheet bundle. Level adjusting means for adjusting a liquid surface level in a accommodation chamber provided with an application roller to increase or decrease is disposed in a glue container. This level adjusting means increases a liquid surface level to a predetermined value or above by replenishing the glue container with a solid adhesive, or is configured to enable adjusting a position of a reflux amount restricting member that restricts (stems) an adhesive amount that is refluxed along a surface of an application roller, or configured to enable moving an occupied position of an accommodated liquid capacity adjusting member that adjusts an allowable accommodation amount of the adhesive in the accommodation chamber. Additionally, the present invention is characterized in that an application length and/or an application width of the sheet bundle is compared with a preset reference value to adjust a liquid amount in a coating layer formed on the surface of the application roller to increase or decrease.

Giving a specific description on this configuration, the apparatus comprises: bungle carrying means for holding the sheet bundle at the applying position; a glue container that accommodates a hot-melt adhesive; an application roller that is arranged in an accommodating chamber of the glue container and formed a coating layer on a surface thereof; roller rotating means for rotating an application roller in a predetermined direction; roller moving means for moving the coating layer in an adhesive applying direction of the sheet bundle; adhesive replenishing means for supplying a solid adhesive into the glue container; and applying operation controlling means for controlling the roller rotating means, the roller moving means, and the adhesive replenishing means.

Further, level adjusting means for adjusting a liquid surface level in the accommodating chamber to increase or decrease is provided in the glue container, and the applying operation controlling means includes: size recognizing means for identifying an application length and/or an application width of the adhesive that is applied to the sheet bundle; and application region comparing means for comparing an identified value from the size recognizing means with a preset reference value. Furthermore, the applying operation controlling means is configured to adjust a liquid amount in the coating layer formed on an application roller by the level adjusting means based on a comparison result from the application region comparing means.

According to the present invention, the level adjusting means provided to the glue container is utilized to adjust a liquid amount in the coating layer formed on the surface of an application roller to increase or decrease in accordance with an application length and/or an application width of the adhesive applied to the sheet bundle, and hence the following effect is demonstrated. First, when each of a rotating speed and a moving speed of the application roller is set to an optimum value according to an application region of a widely used sheet bundle, efficient application processing can be performed. Furthermore, in case of an extremely large or extremely small sheet bundle size that the application region of the sheet bundle is different from the set value, since a liquid amount in the coating layer formed on the surface of the application roller is adjusted to increase or decrease, a predetermined application layer can be always obtained with respect to widespread sheet bundles. Therefore, an insufficient portion where a layer is thin is not produced in the length direction or the width direction of application layer, and hence page missing or a bookbinding quality is not affected.

Furthermore, according to the present invention, when adjusting a liquid amount in the coating layer formed on the surface of the application roller, a liquid surface level in the accommodation chamber can be increased by replenishing the adhesive replenishing portion of the glue container with the solid adhesive in accordance with the application region of the sheet bundle, and the coating liquid amount can be easily adjusted without providing a special configuration. That is, in case of an extremely large sheet bundle size different from a set value, putting the solid adhesive into the glue container enables readily adjusting a liquid amount based on control for increasing a liquid surface level in a storage portion.

Moreover, according to the present invention, when adjusting a liquid amount in the coating layer formed on the surface of the application roller to increase or decrease, a reflux amount restricting member that can adjust a gap from a roll surface is movably provided on a downstream side in a rotating direction of the application roller, and a configuration that can adjust a liquid amount in the coating layer formed on a roller applying portion to increase or decrease is adopted, thereby solving a problem of excessively applying the adhesive to very small size sheets. That is, when this reflux amount restricting member is moved away from the roll surface, a liquid amount (a stemming amount) in the coating layer can be reduced.

Additionally, when an accommodated liquid capacity adjusting member that can adjust an internal capacity to increase or decrease is provided in the accommodating chamber of the glue container so as to allow movement of its occupied position, a liquid amount in the coating layer can be adjusted. That is, the application roller is impregnated with a large amount of the adhesive when the liquid surface level in the storage portion is set to a high value, and the application roller is impregnated with a small amount of the adhesive when the liquid surface level is lowered, thereby forming a liquid amount of the coating layer in accordance with each amount.

DETAILED DESCRIPTION OF THE PREFERRED EMBODIMENTS

The present invention will now be described in detail based on the following illustrated preferred embodiments. An adhesive application apparatus (an adhesive application unit hereinafter) B according to the present invention will now be described. This adhesive application apparatus B is included in a later-described bookbinding apparatus A.

[Configuration of Adhesive Application Unit]

Figure 1A:
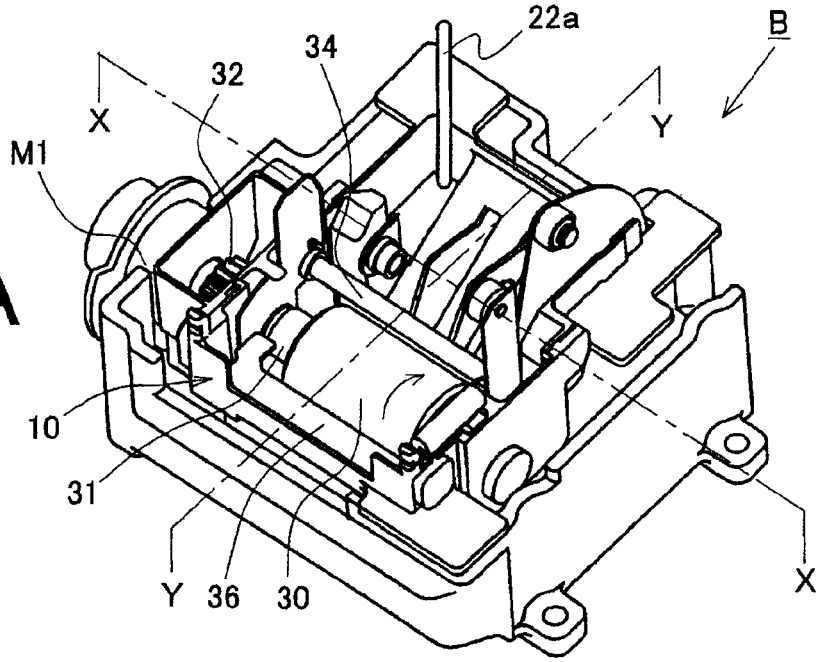
FIG. 1A is a perspective view showing a configuration of a glue container.
Figure 1B:
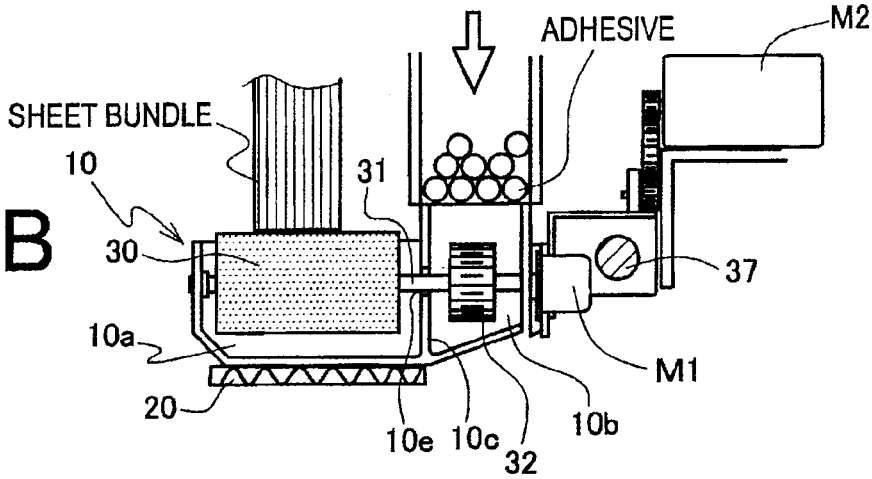
FIG. 1B is an X-X cross-sectional view showing a configuration of the glue container.
Figure 1C:
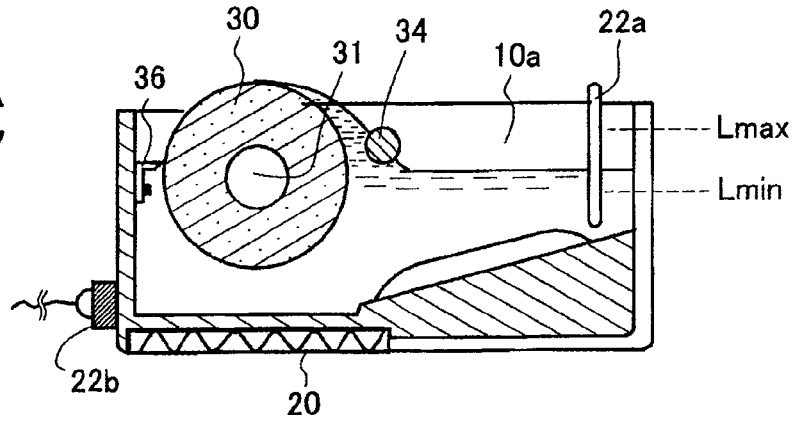
FIG. 1C is a Y-Y cross-sectional view showing a configuration of the glue container.

The adhesive application unit B depicted in FIGS. 1A to 1C includes a glue container 10 that accommodates an adhesive, an application roller 30 that applies the liquefied adhesive to a sheet bundle, and heating means 20 for melting the adhesive put in the glue container. The glue container 10 is partitioned into a solid formulation filling chamber (which will be referred to as a filling chamber hereinafter) 10*b* and a liquid adhesive accommodating chamber 10*a* by a partition wall 10*c*, and a communication opening 10*e* through which the adhesive liquefied in the filling chamber 10*b* flows into the accommodating chamber 10*a* is provided in this partition wall 10*c*. This glue container 10 is constituted of a tub-like tray having the filling chamber 10*b* and the accommodating chamber 10*a*, formed by using a material such as a metal having high heat conductivity or a resin material rich in workability, and configured by providing a heat conducting plate of a metal or the like on a wall surface thereof (e.g., a bottom wall surface).

The application roller 30 is rotatably pivotally supported in the accommodating chamber 10*a*, and this application roller 30 is formed of a heat-resisting gum agent rich in impregnation properties and arranged in such a manner that its upper half portion upwardly protrudes from the accommodating chamber 10*a* and a lower half portion thereof is dipped in a liquid solution of the adhesive in the accommodating chamber 10*a* (see FIG. 1C). Therefore, when this application roller 30 is rotated, the roll lower half portion is impregnated with the liquid adhesive, and the upwardly protruding upper half portion applies the adhesive to a sheet bundle. A rotary shaft 31 of the application roller 30 is arranged to get across the filling chamber 10*b* through the communication opening 10*e*, and an agitator gear 32 that agitates the adhesive in the filling chamber is disposed to this rotary shaft 31.

Further, as shown in FIG. 1B, a roll rotation motor (an agitator motor hereinafter) M1 capable of forward and reverse rotation is coupled with the rotary shaft 31. Therefore, when the roll rotation motor M1 is driven to rotate, the application roller 30 and the agitator gear 32 rotate, the application roller 30 agitates the adhesive in the accommodating chamber, and the agitator gear 32 agitates the adhesive in the filling chamber.

An adhesive sensor (a sensor element that detects a temperature and a liquid amount of the adhesive) 22*a* that can detect a temperature and a liquid amount of the liquefied adhesive is provided in the accommodating chamber 10*a*. The depicted adhesive sensor 22*a* is formed of a rod-like thermistor and arranged in the accommodating chamber 10*a* apart from the application roller 30. This thermistor is formed of an advanced ceramics semiconductor heat sensitive element obtained by sintering several types of transition metal oxides such as Mn, Co, Ni, Fe, Cu and others as raw materials. This adhesive sensor 22*a* detects a temperature and a liquid level of the adhesive (a remaining amount of the adhesive) at the same time.

That is, this rod-like sensor detect a temperature by using a portion put in the liquid of the adhesive, and this detected temperature is utilized to detect a changing region (a change in resistance value), thereby determining a liquid amount. In this case, the adhesive sensor 22*a* is arranged at a position apart from the application roller 30 in the accommodating chamber 10*a* to prevent liquid level detection effected by the adhesive sensor 22*a* from being affected by rotation of the application roller 30. This adhesive sensor 22*a* is connected with a later-described control CPU 60 to detect a near-empty state (L min in the drawing) and a full state (Lmax in the drawing) of the adhesive in the glue container, respectively.

Furthermore, reference numeral 34 in the drawing denotes a reflux amount restricting member, and this member is arranged at a position apart from a roller surface on a downstream side of a rotating direction of the application roller 30. This reflux amount restricting member 34 is utilized to form a liquid pool on the application roller upper portion, thereby constituting an adhesive application layer SL. That is, the reflux amount restricting member 34 is constituted of a rod-like member having an appropriate gap between itself and the roll surface in an axial direction of the application roller 30, and it restricts an adhesive amount that is refluxed by rotation of the application roller 30 to form a liquid pool. Reference numeral 36 in the drawing designates a plate-like blade, and this blade is arranged to form a predetermined gap (a doctor gap) at an outer circumference of the application roller 30 and provided to scrape off the excessive adhesive that has adhered to the application roller outer periphery and to uniform the adhesive.

The heating means 20 is included in the glue container 10. The illustrated heating means 20 is formed of, e.g., an electrothermic heater or a high-frequency heating element and embedded in a bottom surface of the accommodating chamber 10*a* of the glue container 10. Arranging this electrothermic heater (heating means hereinafter) 20 in at least one of the accommodating chamber 10*a* and the filling chamber 10*b* can suffice, but this heater may be arranged in both the chambers. Furthermore, a preliminary electrothermic heater may be arranged in the filling chamber to preliminarily heat the solid adhesive.

The heating temperature control performed by the heating means (the electrothermic heater) 20 will now be described. The adhesive sensor 22*a* is arranged in the glue container as described above, and this adhesive sensor 22*a* is configured to simultaneously detect a liquid amount and a temperature of the adhesive. Moreover, a heated portion temperature sensor 22*b* that detects a temperature of a glue container outer wall heated by the heating means 20 is arranged in the glue container 10. The heated portion temperature sensor 22*b* detects a temperature of the heating means itself and controls a melting temperature of the adhesive together with the adhesive sensor 22*a*.

Additionally, an abnormal temperature sensor (not shown) is provided in the glue container 10, whereby an apparatus power supply is turned off when the adhesive and the glue container 10 accommodating this adhesive are heated to an excessive temperature. Therefore, each of these sensors is connected with the later-described control CPU 60 (see FIG. 10).

[Description on Configuration of Adhesive Applying Operation]

Figure 3:
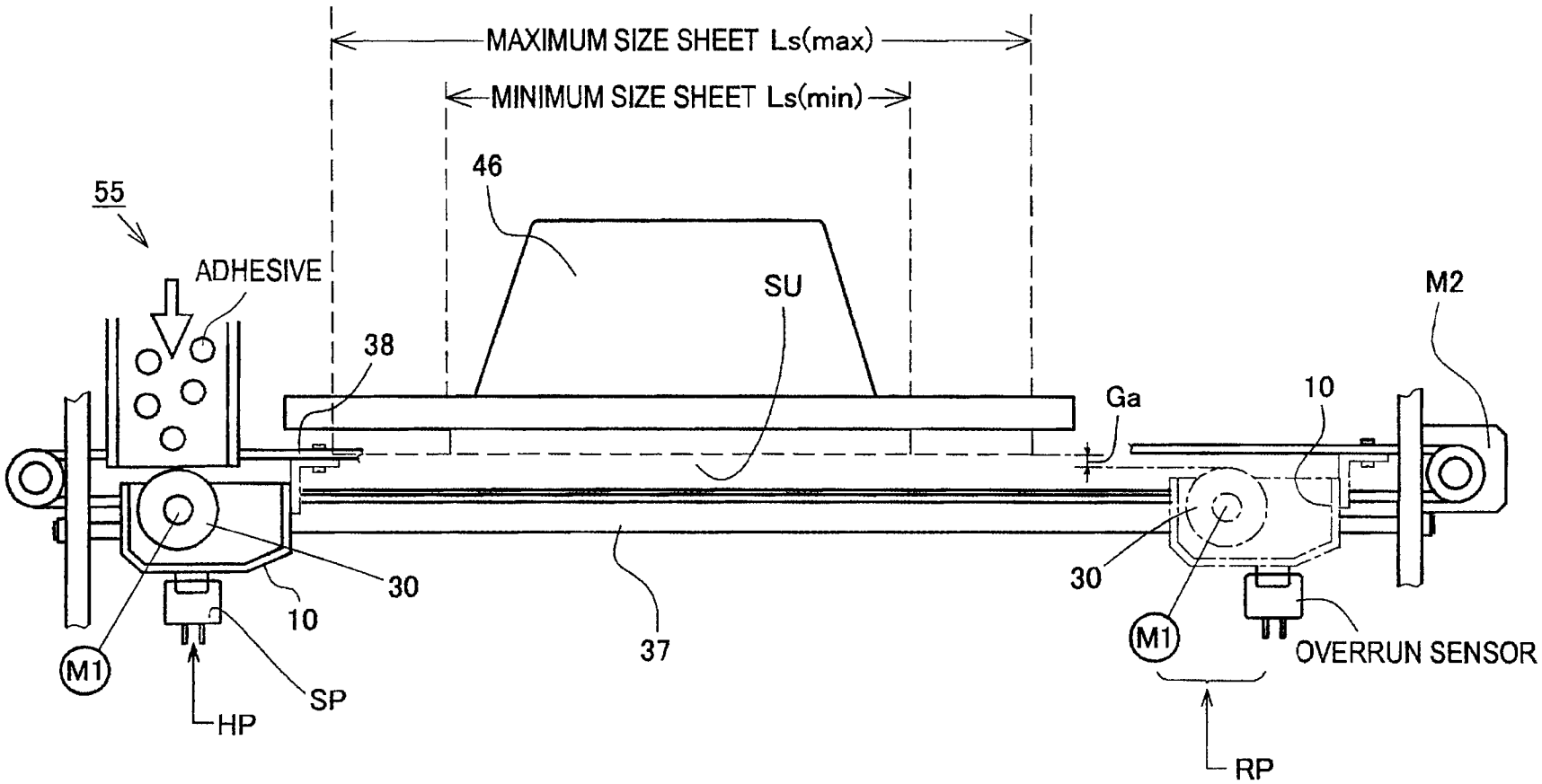
FIG. 3 is an applying operation explanatory view of an adhesive application unit.

The glue container 10 configured as described above is driven to reciprocate along a sheet bundle. Although FIG. 3 is a conceptual view, the glue container 10 is formed with a short length (a dimension) with respect to a lower edge (a back binding end surface) SU of the sheet bundle, and it is supported by a guide rail 37 of an apparatus frame in such a manner that it moves together with the built-in application roller 30 along the lower edge SU of the sheet bundle. Furthermore, this glue container 10 is coupled with a timing belt 38 disposed to the apparatus frame, and a traveling motor M2 is coupled with this timing belt 38.

Thus, the glue container 10 reciprocates between a home position HP and a return position RP at which a return operation starts along the lower edge SU of the sheet bundle by the traveling motor M2. Moreover, each position is set to meet a positional relationship depicted in FIG. 3, and the return position RP is set based on size information of a sheet width. Additionally, the home position HP is set when the apparatus power supply is turned on (at an initial stage), and the glue container 10 moves from the home position HP to the return position RP when a predetermined time (an estimated time required for the sheet bundle to reach an adhesive applying position) elapses from a sheet grip signal from a grip sensor Sg provided to later-described grip carrying means 46, for example. The application roller 30 starts rotation by the roll rotation motor M1 simultaneously with this movement. It is to be noted that SP in the drawing denotes a home position sensor for the glue container 10.

In the thus configured adhesive application unit B, the glue container 10 moves from a left-hand side toward a right-hand side in the drawing along the guide rail 37 by rotation of the traveling motor M2. A supply amount of the grip carrying means 46 can be adjusted by a non-illustrated elevation motor so that the application roller 30 can weld the sheet bundle with pressure to take a sheet end portion apart in this approach path and a predetermined gap can be formed with respect to the sheet and to apply the adhesive in a return path from the return position RP to the home position HP.

Figure 5A:
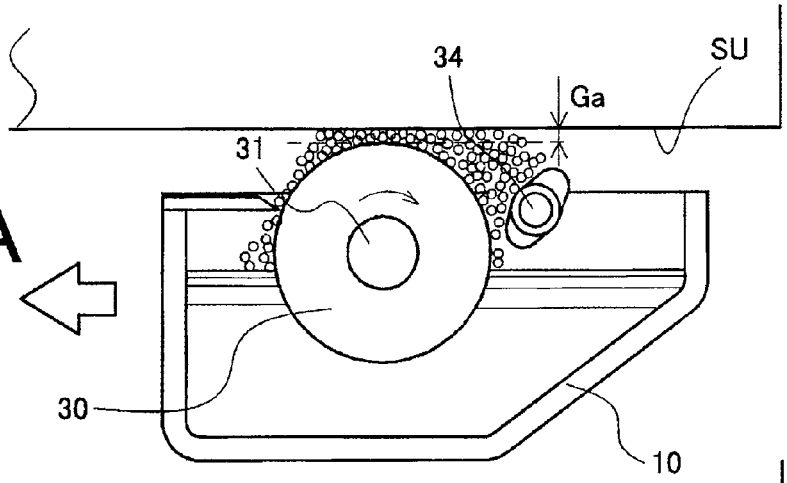
FIG. 5A is an explanatory view when a gap of a reflux amount restricting member according to a second embodiment is large.

Additionally, the thus configured glue container 10 applies the adhesive formed like a layer on the outer periphery of the application roller 30 while moving along the lower edge SU of the sheet bundle supported by the grip carrying means 46. Further, in the return path from the return position RP to the home position HP, the gap Ga is set (Ga>0) to form a predetermined gap as depicted in FIG. 5A. Therefore, the lower edge of the sheet bundle is disjointed in the approach path, and the adhesive is applied to the lower edge S1 of the sheet bundle in the return path.

[Configuration of Adhesive Supplying Means]

Figure 2A:
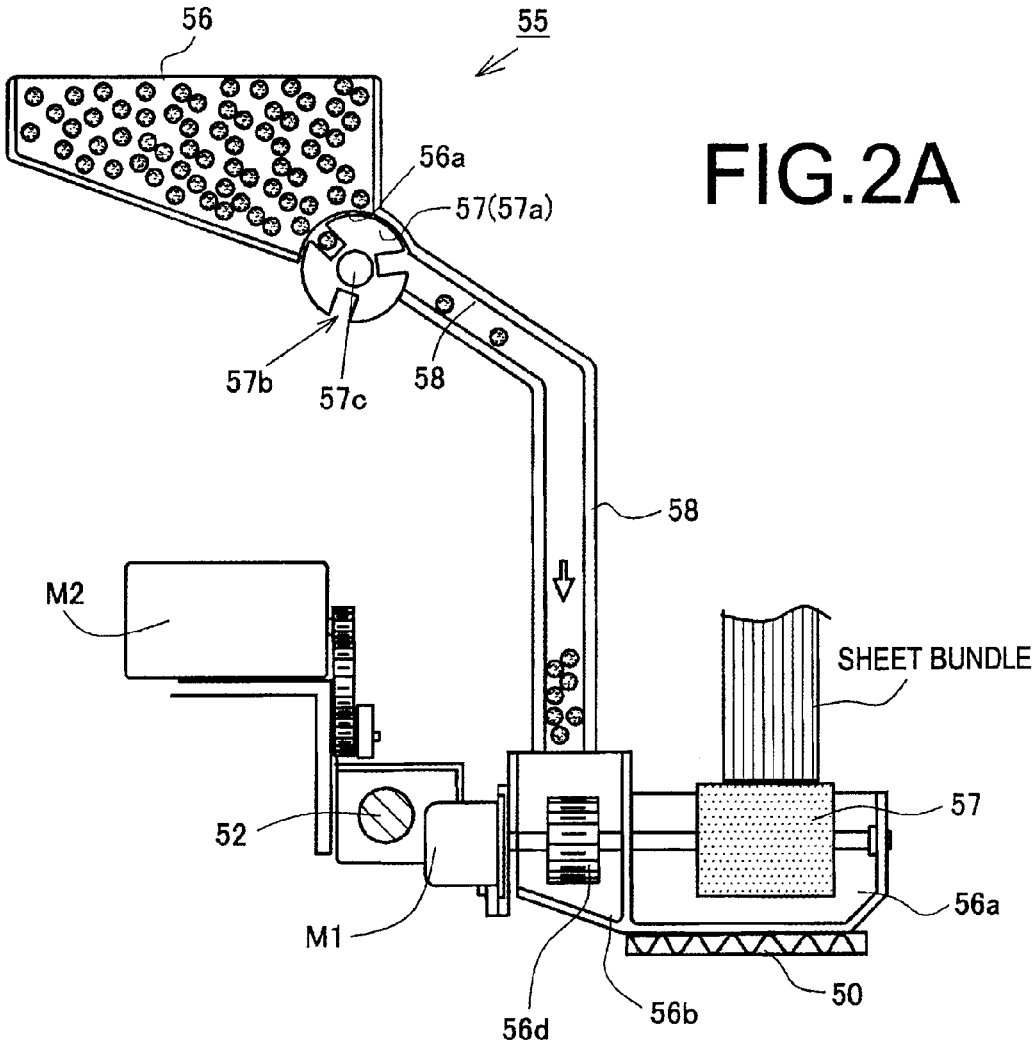
FIG. 2A is an overall structural view showing a structure of adhesive supplying means.

Adhesive supplying means 55 for supplying a solid adhesive into the filling chamber 10*b* is provided at the home position HP of the glue container 10. As shown in FIG. 2A, the adhesive supplying means 55 for replenishing the adhesive in response to a signal (a later-described near-empty signal) from the adhesive sensor 22*a* is provided in the filling chamber 10*b*. This adhesive supplying means 55 is constituted of a hopper 56 that accommodates the adhesive formed into a spherical shape, a weighing mechanism 57 that carries out the adhesive in this hopper simultaneously with weigh-in, and a carrying pipe 58 that carries the adhesive from this weighing mechanism 57 into the filling chamber 10*b* in the glue container 10.

Figure 2B:
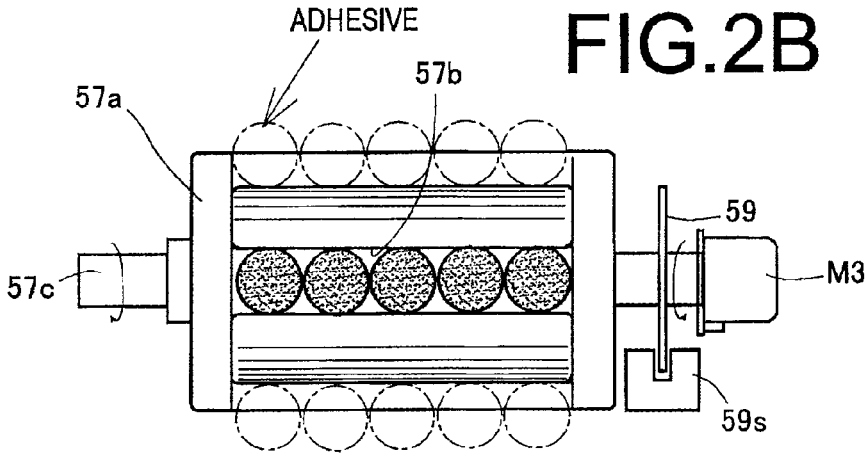
FIG. 2B is a structural view of a weighing mechanism showing a structure of the adhesive supplying means.

The hopper 56 is formed into a box shape having an appropriate capacity and configured to accommodate a lump of a hot-melt adhesive therein and carry out the same from an carry-out opening 56*a* at a hopper bottom portion. The weighing mechanism 57 is arranged in the carry-out opening 56*a* at the hopper bottom portion and configured to supply the adhesive to the carrying pipe 58 on the downstream side while weighing in the adhesive from this carry-out opening 56*a*. Although FIGS. 2A and 2B show an example of this configuration, the illustrated weighing mechanism 57 is formed of a measuring drum 57*a*.

This measuring drum 57*a* has measuring grooves 57*b* each of which coincides with an external diameter of the adhesive (a spherical shape in the drawing) provided on an outer periphery thereof, and a rotary shaft 57*c* is provided at the center of the measuring drum 57*a*. A control motor M3 is coupled with this rotary shaft 57*c*. The measuring grooves 57*b* are provided at three positions on the outer periphery of the illustrated measuring drum 57*a*, and five pieces of adhesive can be accommodated in each measuring groove.

Therefore, five pieces of the adhesive are carried out toward the downstream side when the measuring drum 57*a* makes a ⅓ revolution, 10 pieces of the adhesive are carried out toward the downstream side when the measuring drum 57*a* makes a ⅔ revolution, and 15 pieces of the adhesive are carried out toward the downstream side when the measuring drum 57*a* makes one revolution. Further, an encoder 59 and a position sensor 59S are arranged on the rotary shaft 57*c*, and an arbitrary number of pieces of the adhesive are supplied to the carrying pipe 58 on the downstream side by controlling a rotation angle and the number of revolutions of the measuring drum 57*a* with the later-described control CPU 60.

[Configuration of Adhesive Replenishing Amount Controlling Means]

Detection signals from the adhesive sensor 22*a* arranged in the glue container 10 and the position sensor 59S of the measuring drum 57*a* are transmitted to the later-described control CPU 60. This control CPU 60 constitutes replenishing amount controlling means 61 as follows. When continuously applying the adhesive to the sheet bundle, this replenishing amount controlling means 61 replenishes the adhesive in response to detection of a near-empty state by the adhesive sensor 22*a*. In Embodiment 1 of later-described level adjusting means Re, the replenishing amount controlling means 61 puts the solid adhesive in response to a signal from the control CPU 60 when the adhesive in the accommodating chamber 10*a* is consumed to become insufficient. Further, in Embodiment 1 of the level adjusting means Re, this replenishing amount controlling means 61 fills the filling chamber 10*b* with the solid adhesive to increase a liquid amount in the accommodating chamber 10*a*.

Giving a brief description on the replenishing amount controlling means 61, the control CPU 60 judges whether the adhesive in the accommodating chamber 10*a* is in the near-empty state based on a detection signal from the adhesive sensor 22*a*. Furthermore, in case of the near-empty state, the adhesive is supplied to the filling chamber 10*b*. In regard to the replenishment judgment of the control CPU 60, a liquid amount in the accommodating chamber 10*a* is detected and a preset replenishing amount is resupplied to the filling chamber 10*b* at the time of initialization when activating the apparatus, the end of a job in the apparatus, or the interval of the adhesive applying operation.

Figure 4A:
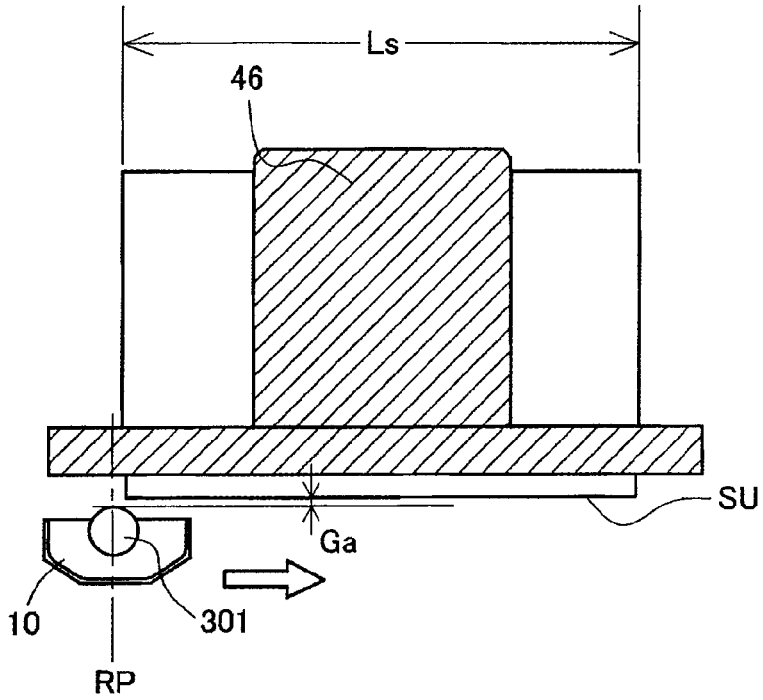
FIG. 4A is a front view of the glue container and sheet bundle carrying means.
Figure 4B:
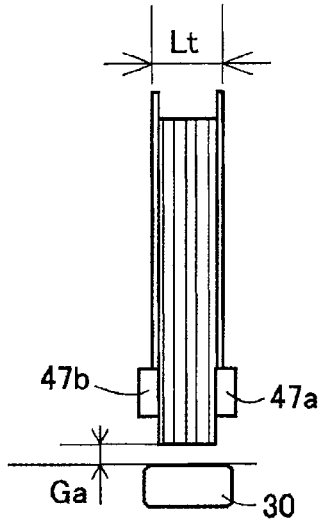
FIG. 4B is a side view of the glue container and the sheet bundle carrying means.
Figure 4C:
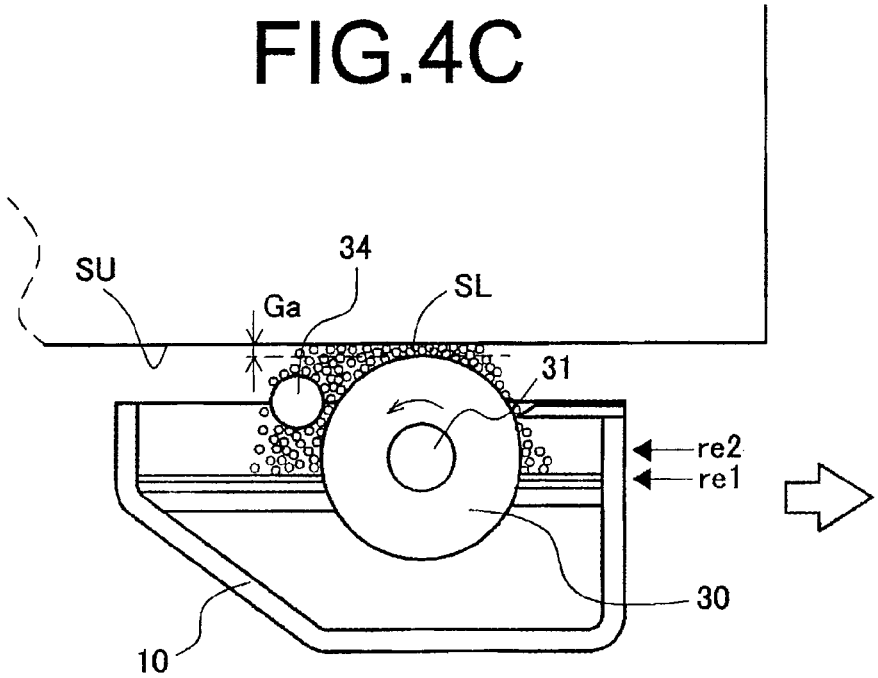
FIG. 4C is an explanatory view of the glue container and a coating application layer of the sheet bundle carrying means.

The present invention is characterized by adjusting a liquid amount of a coating application layer SL (a liquid pool shown in FIG. 4C) that is immersed in the application roller 30 and formed between the application roller 30 and an application surface of the sheet bundle to increase or decrease based on an application length and/or an application width of the sheet bundle in the configuration of the adhesive application unit B. Therefore, the level adjusting means Re for adjusting a liquid surface level (represented as re1 in FIG. 4C) in the accommodating chamber 10*a* to increase or decrease is provided in the glue container 10. This level adjusting means Re is (1) configured to increase the liquid surface level re from re1 to re2 by resupplying the solid adhesive to the later-described glue container 10 as Embodiment 1, (2) configured to enable adjusting a position of the reflux amount restricting member 34 that restricts an adhesive amount that is refluxed (a circulating flow) along the surface of the later-described application roller 30 as Embodiment 2, or (3) configured to enable moving an occupied position of the accommodated liquid capacity adjusting member 51 that adjusts an allowable accommodation amount of the adhesive in the accommodating chamber 10*a*. Each detailed configuration will be described later.

Furthermore, size recognizing means for identifying an application length and/or an application width of the adhesive that is applied to a sheet bundle and application region comparing means 66P for comparing an identified value of this size recognizing means with a preset reference value V are provided to controlling means (the later-described control CPU 60) for controlling each configuration and thereby adjusting a liquid amount in the adhesive application layer SL to increase or decrease. Moreover, applying operation controlling means 66 is configured to adjust a liquid amount in the adhesive application layer SL formed on the application layer 30 by the level adjusting means Re based on the identified value of the application length and/or the application width of the adhesive identified by the size recognizing means and the preset referenced value compared ("comparison result") by this application region comparing means 66P. "Embodiment 1", "the applying operation controlling means 66", "Embodiment 2", and "Embodiment 3" will now be described hereinafter in the mentioned order.

[Embodiment 1]

In the configuration described in conjunction with FIG. 3, the later-described control CPU 60 executes a bookbinding operation by a program (not shown) stored in an ROM. In this process, the applying operation controlling means 66 includes size recognizing means 66S and the application region comparing means 66P. The size recognizing means 66S acquires a sheet size (which is precisely a length Ls of a spine) of a sheet bundle to which the adhesive is applied and bundle thickness (Lt) information of the sheet bundle. In the configuration of the later-described bookbinding apparatus A, the length Ls of the spine is acquired from sheet size information from an image forming apparatus C, and the bundle thickness Lt information of the sheet bundle is obtained from a detection signal from later-described bundle thickness detecting means (not shown). In this manner, the size identification of the sheet bundle to which the adhesive is applied can be acquired from a size of a utilized sheet (a sheet size fed from a feed cassette) from a host device (e.g., an image forming apparatus) placed on the upstream side of the adhesive application unit B, relevant information input from a user, or information obtained by detecting a length size of a sheet transferred through a paper ejection path by using a sensor.

The application region comparing means 66P stores a reference value of an application region serving as a reference in a later-described memory RAM 68 in advance.

This reference value is determined from a design value utilized when setting a rotating speed Vr and a moving speed Vs of the application roller 30 and stored in the RAM 68, for example. This design value is set to a limit value that enables properly forming an application layer of the adhesive when a sheet size is equal to or below A4 size conforming to JIS or a bundle thickness is 40 mm or below. Thus, the application region comparing means 66P is constituted of a comparator that compares a size value acquired from the size recognizing means 66S with the reference value read from the RAM 68.

When the application region of the sheet bundle to which the adhesive is to be applied is in the reference value based on a comparison result obtained by comparison in the application region comparing means 66P, the applying operation controlling means 66 supplies an adhesive replenishment instruction signal to the later-described replenishing amount controlling means 61 to fill the filling chamber 10*b* of the glue container 10 with the solid adhesive. This filling operation is executed when the glue container 10 waits at the home position HP and the hopper 56 is placed in the filling chamber 10*b*. Moreover, the replenishing amount controlling means 61 is configured to transmit a replenishing amount instruction signal simultaneously with an adhesive replenishment instruction signal from the applying operation controlling means 66. Thus, the glue container 10 is filled with an instructed amount of the solid adhesive at a timing instructed from the replenishing amount controlling means 61.

As described above, in Embodiment 1, the adhesive supplying means 55 that resupplies the adhesive to the glue container 10 supplies a predetermined amount of the solid adhesive by using the applying operation controlling means 66 based on a comparison result from the application region comparing means 66P different from a replenishment timing for the adhesive. Based on this filling amount, the liquid surface level in the accommodating chamber 10*a* is increased from re1 to re2 (see FIG. 4C).

Figure 11:
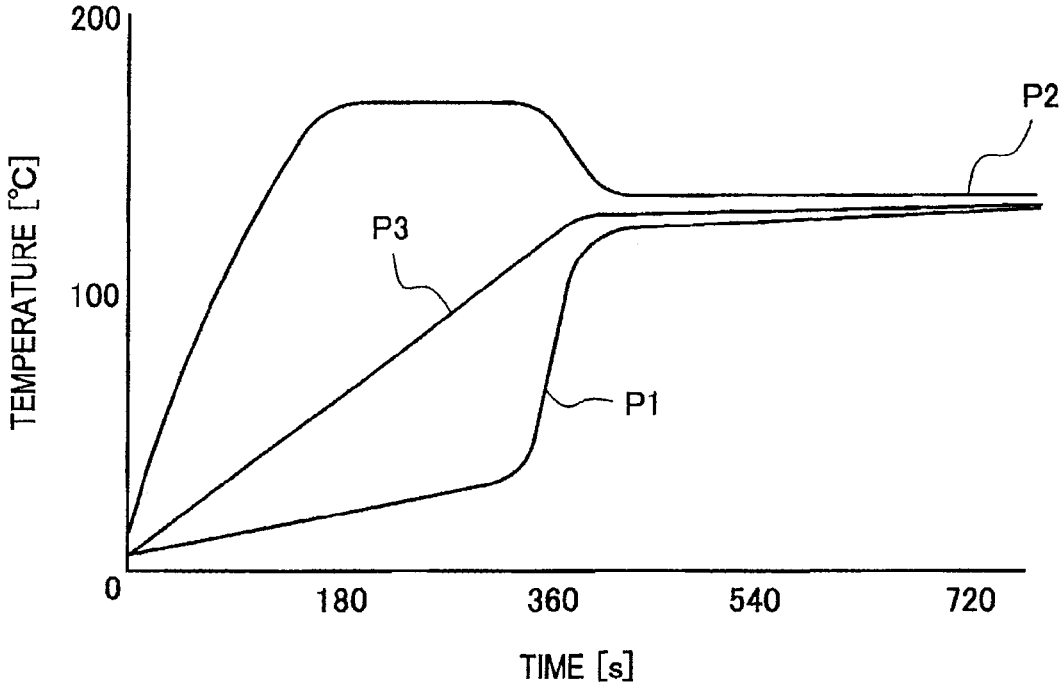
FIG. 11 is a graph chart showing an adhesive temperature relationship.
Figure 12:
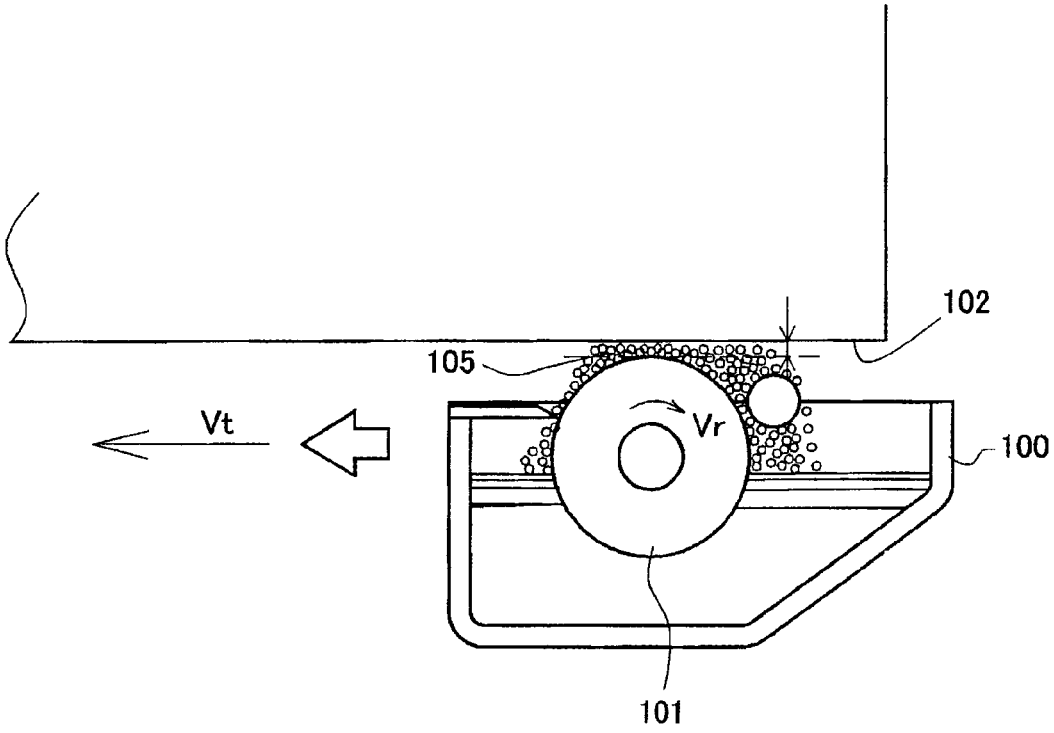
FIG. 12 is an explanatory view of an adhesive application state in a conventional apparatus.

An adhesive temperature relationship in Embodiment 1 will now be described with reference to FIG. 11. The adhesive supplied into the solid formulation filling chamber 10*b* of the glue container 10 increases the liquid surface level re of the adhesive in the liquid accommodating chamber 10*a* simultaneously with putting the adhesive. At this time, a temperature P1 of the adhesive application layer SL, a temperature P2 of the built-in heating means 20 in the glue container 10, and an adhesive temperature P3 in the accommodating chamber 10*a* demonstrate characteristics depicted in FIG. 11. Thus, when the adhesive temperature P3 reaches a preset temperature, the applying operation controlling means 66 executes an operation of moving the glue container 10 in an applying direction to apply the adhesive to the lower edge SU of the sheet bundle. In case of this Embodiment 1, it is preferable to form the communication opening 10*e* between the filling chamber 10*b* and the accommodating chamber 10*a* as a hole having a small diameter so as to prevent a liquid temperature in the accommodating chamber 10*a* from being drastically reduced due to filling using the solid adhesive.

[Embodiment 2]

Figure 5B:
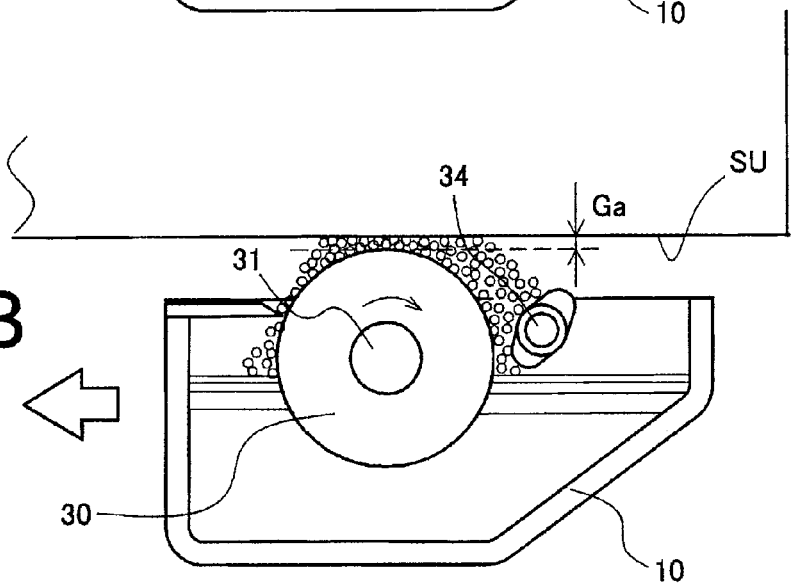
FIG. 5B is an explanatory view when the gap of the reflux amount restricting member according to the second embodiment is small.
Figure 5C:
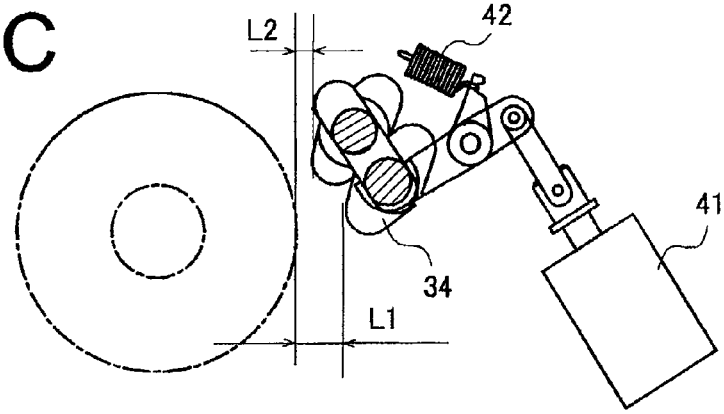
FIG. 5C is a structural explanatory view of a reflux amount restricting member of the reflux amount restricting member according to the second embodiment.

Embodiment 2 will now be described. As shown in FIGS. 5A to 5C, the above-described application roller 30 is rotatably disposed in an accommodating chamber 10*a* of a glue container 10. An adhesive in an adhesive application layer SL is refluxed in the accommodating chamber 10*a* while adhering to an outer periphery of a roll along a rotating direction of this application roller 30. A reflux amount restricting member 34 is provided on a downstream side of a rotating direction of this application roller outer periphery. A predetermined gap L is provided between this reflux amount restricting member 34 and the application roller surface. An adhesive amount in the adhesive application layer SL is small when this gap L is large, and an adhesive amount in the adhesive application layer SL is large when the gap L is small. Therefore, the reflux amount restricting member 34 is supported so as to be movable in the glue container 10, e.g., so as to movable through a long hole bearing 40. This reflux amount restricting member 34 is arranged to be parallel to the roll surface in an axial direction of the application roller 30, and it is arranged to store a liquid on a roll upper surface and form the adhesive application layer SL.

Thus, restricting position shifting means (an actuating solenoid in the drawing) 41 is coupled with the reflux amount restricting member 34, and this reflux amount restricting member 34 is positioned at a location where a predetermined gap L1 is formed between itself and the application roller 30 by using a biasing spring 42. Further, when the actuating solenoid 41 is energized for activation, a gap L2 (L2<L1) is formed between the reflux amount restricting member 34 and the application roller 30. Therefore, the restricting position shifting means 41 can be used for setting a gap (L2) between the application roller 30 and the reflux amount restricting member 34 to be narrow, thereby increasing a liquid amount in the adhesive application layer SL.

The restricting position shifting means 41 is controlled by applying operation controlling means 66 like Embodiment 1, and this applying operation controlling means 66 includes size recognizing means 66S and application region comparing means 66P that are equal to those described above.

[Embodiment 3]

Figure 6A:
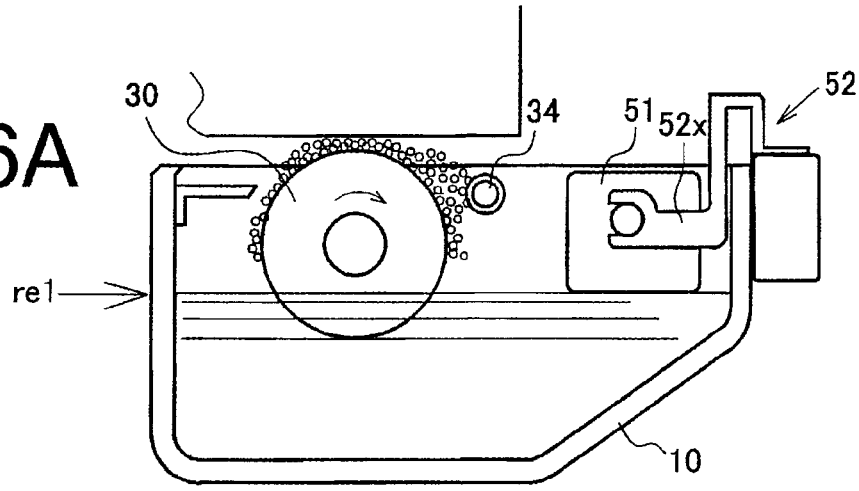
FIG. 6A is an explanatory view when a liquid surface level in an accommodated liquid capacity adjusting member is low.
Figure 6B:
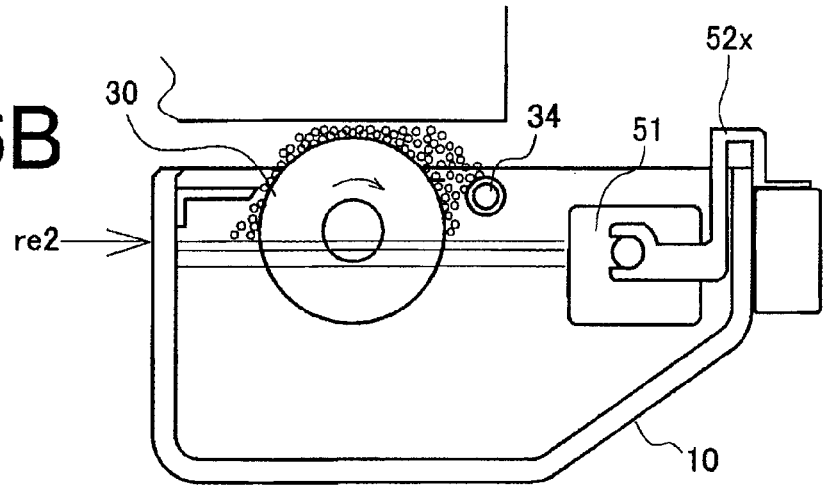
FIG. 6B is an explanatory view when the liquid surface level in the accommodated liquid capacity adjusting member is high.
Figure 6C:
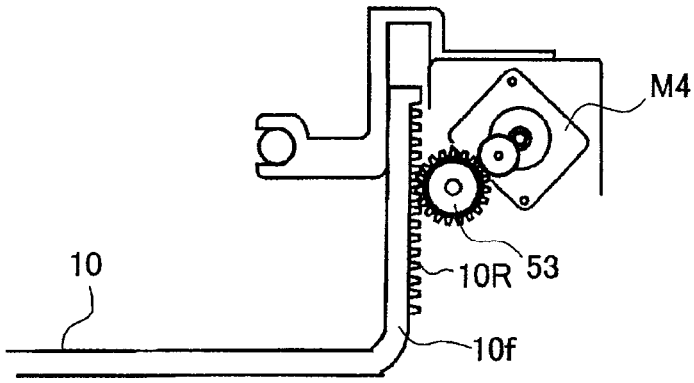
FIG. 6C is a driving structure explanatory view of an adjustment member of the accommodated liquid capacity adjusting member.

Embodiment 3 will now be explained. As shown in FIGS. 6A to 6C, this Embodiment 3 is configured to increase or decrease a liquid surface level re of an adhesive by changing an adhesive accommodation capacity of an accommodating chamber 10*a*. Therefore, an accommodated liquid capacity adjusting member 51 is arranged in a liquid accommodating chamber 10*a* of a glue container 10. This accommodated liquid capacity adjusting member 51 is arranged like a float in a liquid in the accommodating chamber 10*a* of the glue container 10, and the liquid surface level re is increased from a liquid surface level re1 in FIG. 6A to a liquid surface level re2 in FIG. 6B when this member is immersed in the liquid.

An occupied position shifting means 52 is provided to the accommodated liquid capacity adjusting member (which is referred to as a float member) 51. This occupied position shifting means 52 includes a support lever 52*x* that suspends the float member 51 in the accommodating chamber 10*a*, a driving gear 53 provided to this support lever 52*x*, a rack gear 10R formed on a frame (a container outer wall in the drawing) 10*f*, and a micro motor M4 coupled with the driving gear 53. Based on this configuration, the support lever 52*x* moves down from an upper position in FIG. 6A to a lower position in FIG. 6B by driving rotation of the micro motor M4. Further, a liquid surface level re increases to a liquid surface level re2 at the lower position from a liquid surface level re1 at the lever upper position. As described above, a liquid amount of the adhesive in an adhesive application layer SL formed on an application roller upper portion is increased or decreased by rise of the liquid surface level re. That is, a liquid amount in FIG. 6B is increased beyond a liquid amount in the adhesive application layer SL at the liquid surface level re1 in FIG. 6A.

[Configuration of Bookbinding Apparatus]

Figure 7:
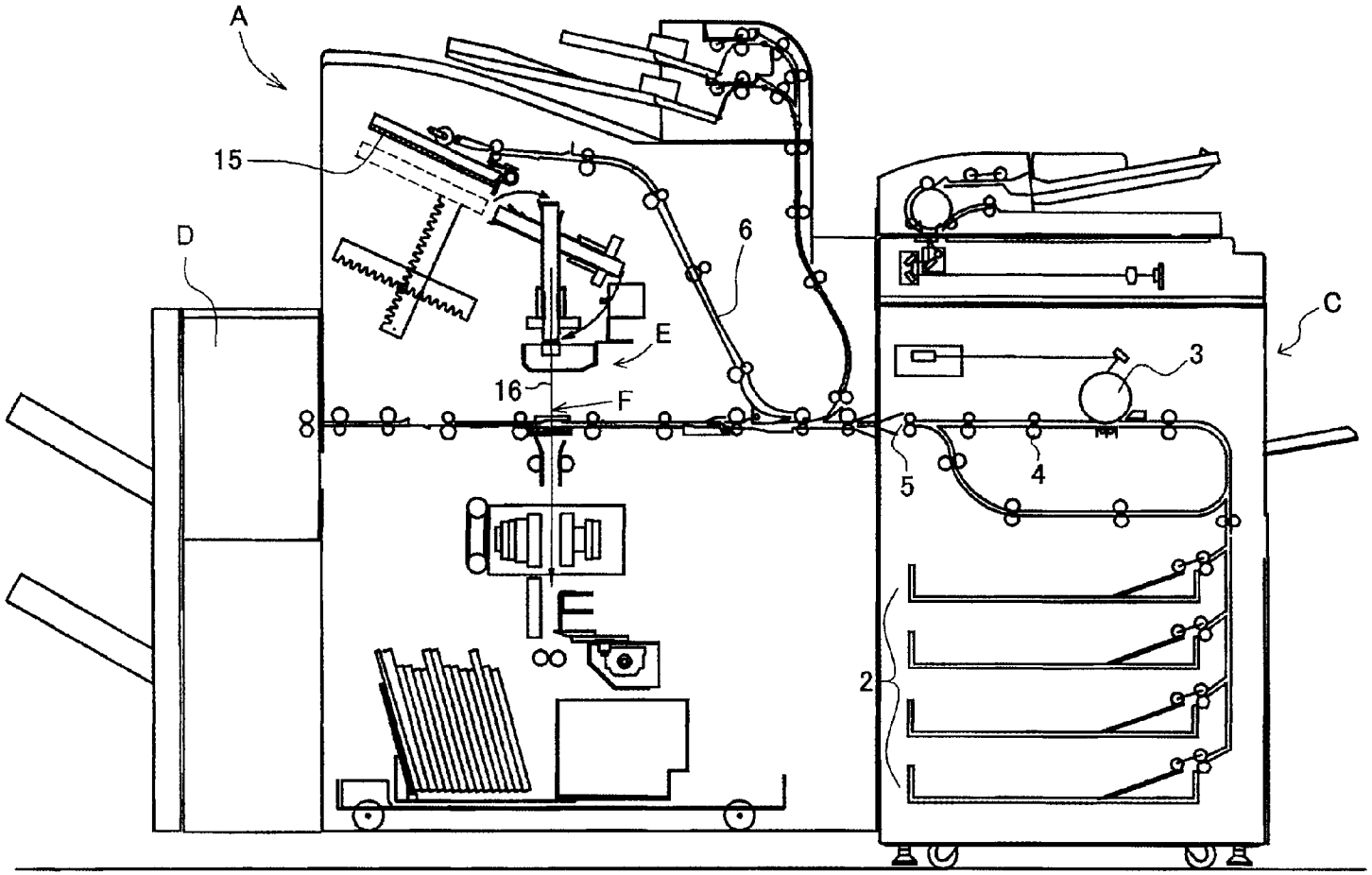
FIG. 7 is an overall explanatory view of a bookbinding apparatus having a built-in adhesive application unit depicted in FIGS. 1A to 1C and an image forming system.
Figure 8:
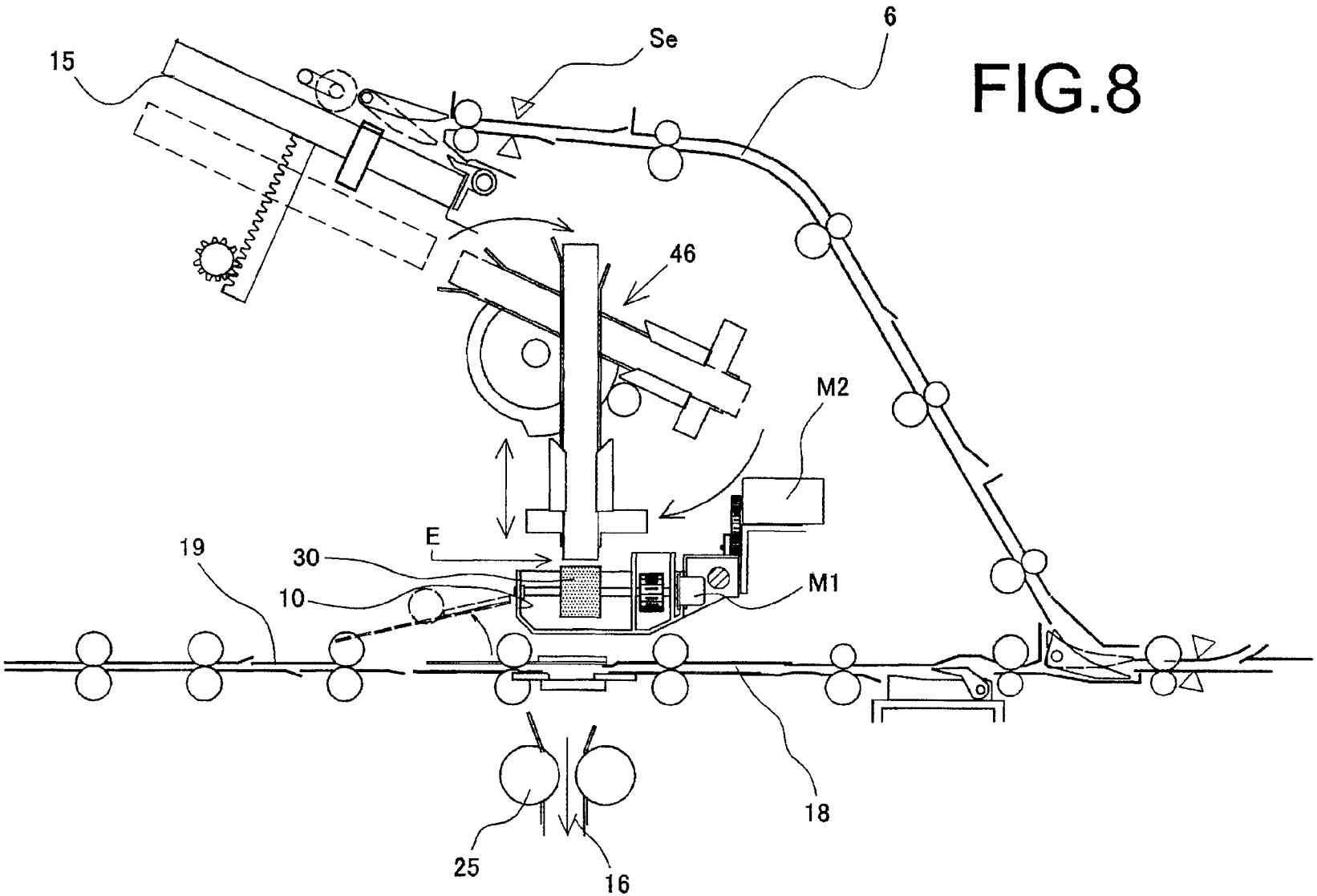
FIG. 8 is an explanatory view of a primary part of a bookbinding apparatus portion depicted in FIG. 7.

A description will now be given on a bookbinding apparatus A whose overall configuration is shown in FIG. 7 and whose primary part configuration is depicted in FIG. 8. Each of the drawings includes an image forming apparatus C and a bookbinding apparatus A that binds printed sheets from this image forming apparatus C like a booklet, and a stacker apparatus D that carries out and accommodates printed sheets that are not bound is additionally provided to this bookbinding apparatus A. This image forming apparatus C is configured as a known structure like a printer or a copying machine. The illustrated apparatus feeds a predetermined sheet from a cassette prepared in a paper feed portion 2, performs printing on this sheet by using, e.g., a print drum 3, effects thermal fixation by using a fixer 4, and then sequentially carries out the sheet from a paper ejection opening 5. The illustrated print drum 3 is a photoconductor drum and adopts an electrostatic printing scheme for forming an electrostatic latent image on a surface of this drum by a laser oscillator to be transferred onto a sheet. Besides, various printing schemes such as silk screen printing or inkjet printing can be adopted.

Subsequently, the bookbinding apparatus A bundles and aligns printed sheets sequentially ejected from the paper ejection opening 5 as a copy in accordance with each document by using an accumulation tray 15. Reference numeral 6 in the drawing denotes a carry-in path through which each printed sheet is guided to the accumulation tray 15 from the paper ejection opening 5. The sheet bundle bundled as a copy and aligned on the accumulation tray 15 is carried to an adhesive applying position E by grip carrying means 46. In particular, the accumulation tray 15 is arranged in a substantially horizontal posture and a bookbinding path 16 through which the sheet bundle is transferred by using the grip carrying means 46 is arranged in a substantially vertical direction in the drawing. The grip carrying means 46 uses a pair of gripper means to grip and hold the sheet bundle from front and back sides, first deflects the sheet bundle from the horizontal posture to the vertical posture, and carries it to the bookbinding path 16 in the vertical direction.

A cover sheet carrying path 18 through which a cover sheet is fed is branched and connected to the carry-in path 6, and a carry-out path 19 is connected to this cover sheet carrying path 18. That is, each printed sheet from the paper ejection opening 5 of the image forming apparatus C is transferred to the accumulation tray 15 from the carry-in path 6, and the cover sheet carried out from the paper ejection opening 5 is fed to the cover sheet carrying path 18 branched from the path 6. At the same time, each printed sheet from the paper ejection opening 5 that is not subjected to bookbinding processing is carried to the stacker apparatus D from the carry-out path 19 through the carry-in path 6 and the cover sheet carrying path 18 to get across the bookbinding apparatus A.

The bookbinding apparatus 16 and the cover sheet carrying path 18 are arranged so as to cross each other, and the sheet bundle carried from the bookbinding path 16 is combined with the cover sheet carried from the cover sheet carrying path 18 at a cover binding position F. That is, the cover sheet is carried and supplied to the cover binding position F in such a manner that a central line matches with an intersection, and the sheet bundle is caused to abut on the cover sheet from the bookbinding path 16 orthogonal to the former path in an inverted T shape, and these sheets are subjected to case work binding by a bending roll 25 arranged in the bookbinding path 16 on the downstream side of the cover binding position F. Thus, the adhesive application unit B is incorporated on the upstream side of the cover binding position F.

A predetermined amount of adhesive (glue) is applied to a lower edge of the sheet bundle that is gripped by the grip carrying means 46 and held in an inverted posture at an adhesive applying position E. In this adhesive application unit B, the glue container 10 is arranged to be movable along the lower edge SU of the sheet bundle described in conjunction with FIGS. 1A to 3. The glue container 10 including heating means 20 has the above-described configuration, thereby omitting a description thereof.

[Bundle Thickness Detecting Means]

Moreover, bundle thickness detecting means for detecting a thickness of an accumulated bundle sheet is arranged in the accumulation tray 15. According to this bundle thickness detecting means, although not shown, for example, a nip piece that comes into contact with the uppermost sheet is arranged in the accumulation tray 15 to be movable in a tray vertical direction, and a slidax sensor or the like is utilized to detect a position at which this nip piece comes into contact with the uppermost sheet in the accumulation tray. Furthermore, a bundle thickness of the sheet bundle accumulated in the accumulation tray is calculated by detecting a distance (a gap) between a contact position of the nip piece and a reference position such as a home position.

Figure 9:
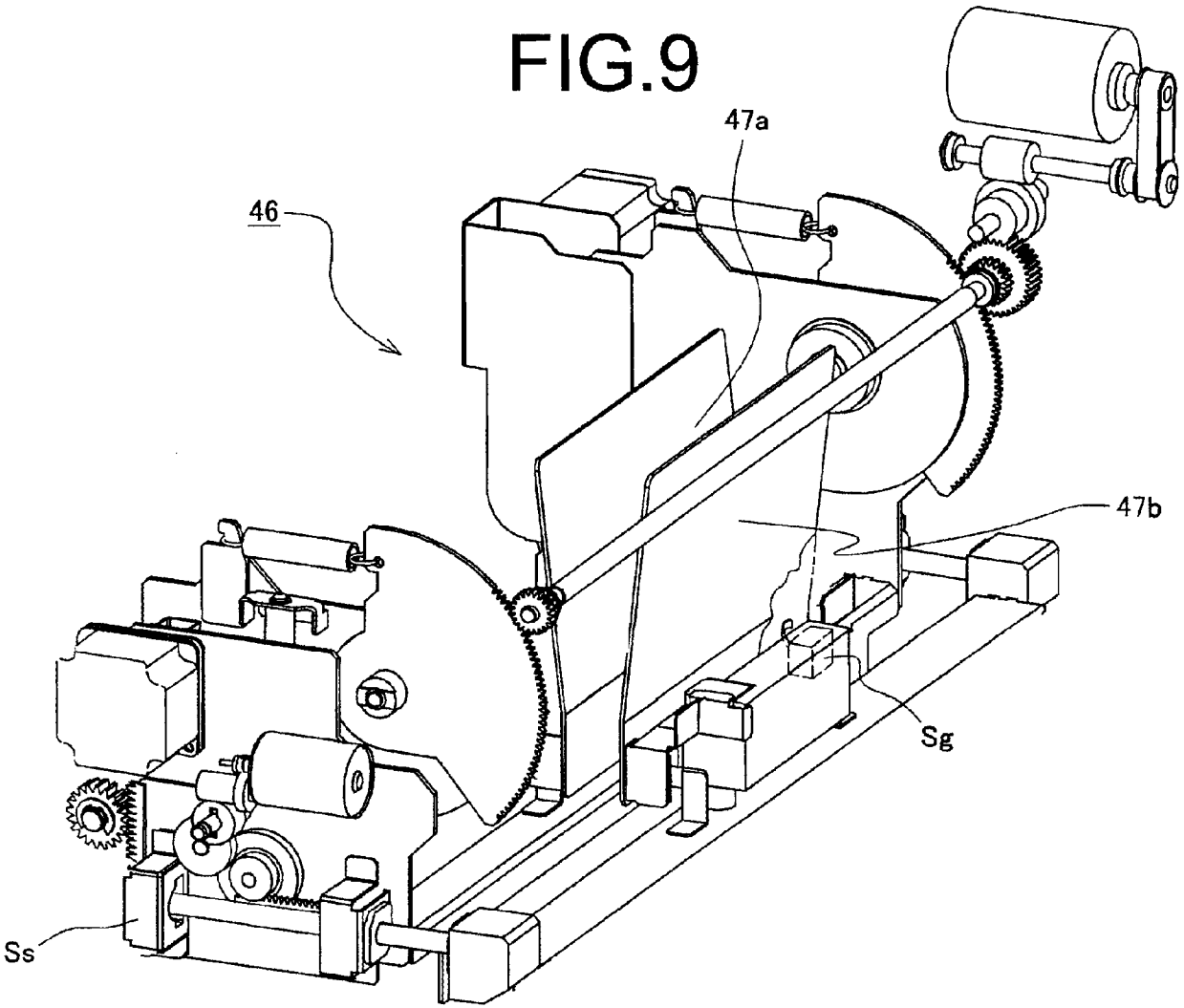
FIG. 9 is a perspective view showing a configuration of the sheet bundle carrying means that sets the adhesive at an applying position for carriage.

The bundle thickness detecting means (not shown) may be arranged in the accumulation tray 15 or may be arranged to the later-described grip carrying means 46. When the bungle thickness detecting means is arranged to this grip carrying means 46, a thickness of a sheet bundle nipped between a movable grip member 47*b* and a fixed grip member 47*a* can be detected by detecting a moving distance (a nip operation amount) of the movable grip member 47*b* by using, e.g., a slide sensor Ss (see FIG. 9). Moreover, the bundle thickness detecting means detects an edge of each sheet accumulated in the accumulation tray 15 by a paper ejection opening sensor denoted by Se in FIG. 2 and counts detection values to detect a total number of sheets in an intermediate sheet bungle accumulated in the accumulation tray. Additionally, a bundle thickness can be detected by multiplying this total number of sheets by an average sheet thickness or a maximum sheet thickness without effecting actual measurement.

Further, the stacker apparatus D is formed of a paper ejection tray 23 in which sheets carried out from a carry-out opening 14 of the carry-out path 19 connected with the cover sheet carrying path 18 are sequentially stacked and accommodated. Furthermore, a post-processing unit that carries out post-processing such as stapling, punching, or stamping with respect to each sheet from the carry-out opening 14 may be provided to this stacker apparatus D. As to the post-processing unit in this case, an already known preferred mechanism can be adopted.

[Configuration of Controlling Means]

Figure 10:
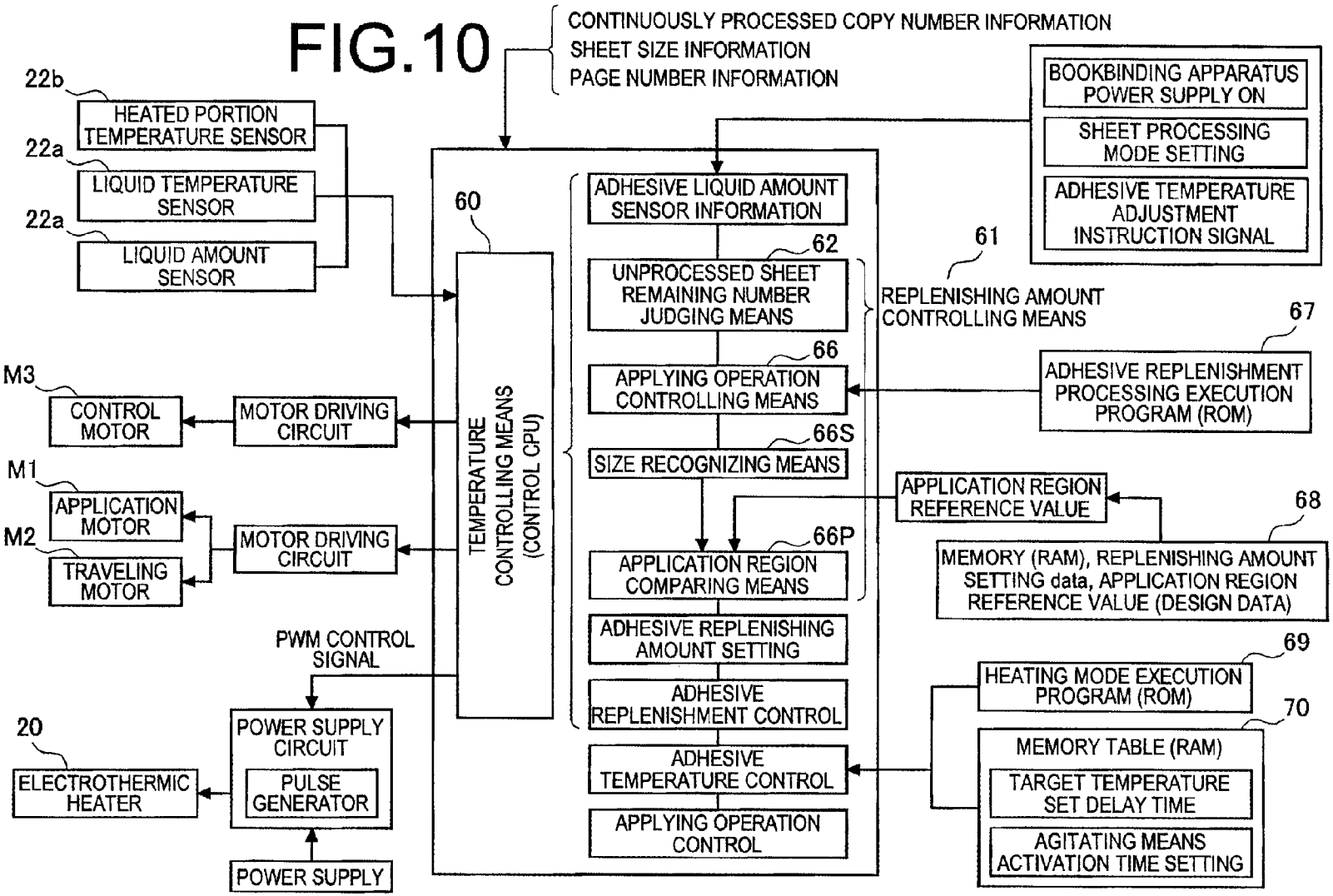
FIG. 10 is a block diagram showing a control configuration of the bookbinding apparatus.

A control configuration in the image forming system will now be described. FIG. 10 is a block diagram showing a control configuration of the bookbinding apparatus A. A control unit of this bookbinding apparatus A is formed of a control CPU 60, and this control CPU 60 is configured to execute a bookbinding processing operation by reading a program for carrying out the bookbinding processing operation from an ROM (not shown). This ROM includes an adhesive replenishment control program 67 and a temperature control program 69 for controlling an adhesive temperature. Furthermore, an RAM 68 stores control data required for each control, and this RAM 68 includes control data 68*a* concerning adhesive replenishment and control data 68*b* concerning temperature control. Moreover, in the control data 68*a*, an adhesive amount that is supplied when the control CPU 60 resupplies the adhesive to the glue container 10 in response to a detection signal from the adhesive sensor (a liquid amount sensor) 22*a* and an adhesive amount when the applying operation controlling means 66 resupplies the adhesive for adjusting a liquid surface level re to increase or decrease based on a comparison result from the application region comparing means 66P are prepared as data.

Additionally, the control CPU 60 is connected with the adhesive sensor 22*a* and the heated portion temperature sensor 22*b* to transmit a detection signal from each sensor. Further, the control CPU 60 is connected with a position sensor 59S that detects the encoder 59 (not shown). On the other hand, the control CPU 60 is wire-connected to drive and control the roll rotation motor M1, the traveling motor M2, and the control motor M3 through respective driving circuits.

What is claimed is:

1. An adhesive application apparatus that applies an adhesive for bookbinding to a sheet bundle held at a predetermined applying position, comprising:

bungle carrying means for holding the sheet bundle at the applying position;

a glue container that accommodates a hot-melt adhesive;

an application roller, being arranged in an accommodating chamber of the glue container, for forming a coating layer on a surface thereof;

roller rotating means for rotating an application roller in a predetermined direction;

roller moving means for moving the application roller to an adhesive applying direction of the sheet bundle;

adhesive replenishing means for supplying a solid adhesive into the glue container; and applying operation controlling means for controlling the roller rotating means, the roller moving means, and the adhesive replenishing means, wherein level adjusting means for adjusting a liquid surface level in the adhesive accommodating chamber is provided in the glue container, formed with the adhesive replenishing means extended to an adhesive replenishing portion of the glue container, the applying operation controlling means includes:

reference value storing means for previously setting and storing a preset reference value of an application length and/or an application width of the sheet bundle;

size recognizing means for identifying an application length and/or an application width of the adhesive that is applied to the sheet bundle; and application region comparing means for comparing an identified value of the application length and/or the application width of the adhesive that is applied to the sheet bundle from the size recognizing means with the preset reference value of the application length and/or the application width of the sheet bundle from the reference value storing means means, and the applying operation controlling means is configured to adjust a liquid amount in the coating layer formed on the application roller by the level adjusting means, to adjust a liquid surface level in the accommodating chamber by putting a predetermined amount of the solid adhesive from the adhesive replenishing means, and to set a replenishing amount of the solid adhesive from the adhesive replenishing means, based on the identified value and the preset reference value compared by the application region comparing means.

2. The adhesive application apparatus according to claim 1, wherein heating means for putting and thermally melting the solid adhesive resupplied to the adhesive replenishing portion and heating controlling means are provided in the glue container, and in the heating controlling means, the applying operation controlling means controls the replenishing amount of the solid adhesive from the adhesive replenishing means and a melt time of the heating means based on the replenished amount of the solid adhesive.

3. A bookbinding apparatus comprising:

accumulating means for bundling and accumulating sequentially fed sheets as a copy;

a sheet bundle carrying path through which the sheet bundle is guided to a predetermined applying position from the accumulating means;

sheet bundle carrying means for transferring the sheet bundle to be held at the applying position; and an adhesive application apparatus that is arranged at the applying position and applies the adhesive to a back end face of the sheet bundle, wherein the adhesive application apparatus has the configuration according to claim 1.

* * * * *